US010285245B2

(12) United States Patent
Meerbeek et al.

(10) Patent No.: US 10,285,245 B2
(45) Date of Patent: May 7, 2019

(54) LIGHT SCENE CREATION OR MODIFICATION BY MEANS OF LIGHTING DEVICE USAGE DATA

(71) Applicant: SIGNIFY HOLDING B.V., Eindhoven (NL)

(72) Inventors: Berent Willem Meerbeek, Eindhoven (NL); Abraham Antonius Arnoldus Bos, Geldrop (NL); Bartel Marinus Van De Sluis, Eindhoven (NL); Roel Peter Geert Cuppen, Venlo (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/316,313

(22) PCT Filed: Jun. 4, 2015

(86) PCT No.: PCT/EP2015/062530
§ 371 (c)(1),
(2) Date: Dec. 5, 2016

(87) PCT Pub. No.: WO2015/185704
PCT Pub. Date: Dec. 10, 2015

(65) Prior Publication Data

US 2017/0156193 A1 Jun. 1, 2017

(30) Foreign Application Priority Data

Jun. 5, 2014 (EP) ..... 14171319

(51) Int. Cl.
*H05B 37/02* (2006.01)
*H05B 33/08* (2006.01)

(52) U.S. Cl.
CPC ..... *H05B 37/0227* (2013.01); *H05B 33/0842* (2013.01); *H05B 37/0272* (2013.01)

(58) Field of Classification Search
CPC .... H05B 33/08; H05B 33/0842; H05B 37/02; H05B 37/0227; H05B 37/0272; H05B 37/0218
See application file for complete search history.

(56) References Cited

U.S. PATENT DOCUMENTS

2007/0258243 A1 11/2007 Segall
2009/0243517 A1* 10/2009 Verfuerth ..... H05B 37/0272 315/315
2010/0259197 A1* 10/2010 Boleko Ribas ..... H05B 37/02 315/312

FOREIGN PATENT DOCUMENTS

DE 4029274 A1 4/1991
WO 2006111934 A1 10/2006
WO 2014006525 A2 1/2014
WO WO 2014006525 A2 * 1/2014 ..... H05B 37/0218

* cited by examiner

*Primary Examiner* — Thai Pham
(74) *Attorney, Agent, or Firm* — Meenakshy Chakravorty

(57) ABSTRACT

A processing module (20) is disclosed, which is configured to receive usage data for at least one lighting device (11-15) and on basis of the usage data determine a lighting device settings profile for the at least one lighting device (11-15).

18 Claims, 2 Drawing Sheets

LIGHT SCENE CREATION OR MODIFICATION BY MEANS OF LIGHTING DEVICE USAGE DATA

CROSS-REFERENCE TO PRIOR APPLICATIONS

This application is the U.S. National Phase application under 35 U.S.C. § 371 of International Application No. PCT/EP2015/062530, filed on Jun. 4, 2015, which claims the benefit of European Patent Application No. 14171319.8, filed on Jun. 5, 2014. These applications are hereby incorporated by reference herein.

TECHNICAL FIELD OF THE INVENTION

The present invention generally relates to the field of controllable or adjustable lighting systems or devices. Specifically, the present invention relates to a processing module configured to receive usage data for at least one lighting device and on basis of the usage data determine a lighting device settings profile for the at least one lighting device.

BACKGROUND OF THE INVENTION

The use of light-emitting diode (LED) lighting systems, or other lighting systems including controllable or adjustable light sources other than LEDs, allow for increasingly more complex light scene setting. LED lighting systems often include a multitude of LEDs, and allow for controlling various lighting parameters, e.g. including intensity and color, of light emitted by the individual light sources in the lighting system. One example of such a LED lighting system is the 'Hue' lighting system by Philips, which includes wirelessly connected LED light sources. The Hue lighting system may allow for users to control emitted light and create scenes for example by means of a so called smartphone. Connectivity to the Internet or another public network, or to a private network, may allow for distribution or sharing of light scenes between users in a community and retrieval or downloading of light scenes, i.e. retrieval or downloading of settings of the light sources included in the lighting system for achieving a certain light output by the lighting system.

WO 2014/006525 A2 discloses a method and a lighting system for at least one workstation at which steps of a production process are executed. Lamp(s) at these workstation(s) are controlled according to one or more of the following criteria: the workflow of the process, the requirements with respect to cognitive performance, motor skills and/or attention of a user at the workstations, and/or the performance of the process.

US 2009/0243517 A1 discloses a controller for controlling a plurality of devices configured for wireless communications in a facility, the controller including a data communications interface communicating with at least one of the devices. The controller further includes a control module configured to provide a control signal to the data communications interface for communicating to a transceiver associated with the device and for turning off the device according to an algorithm wherein the control signal is provided based on a time of day and/or a sensed condition relating to use of the facility. The transceiver reports device data to the control module to quantify a reduction in power obtained by controlling the devices according to the algorithm.

US 2007/0258243 A1 discloses a lighting system for delivering a dynamic, fully customized, and automatic illumination to a subject. The lighting system comprises a programmable light unit for emitting a programmed pattern and spectra of illumination, a sensor pod comprising an array of sensors for detecting ambient lighting conditions and subject characteristics, a control unit for allowing a user to program the lighting system, and a processing unit for analyzing data from the sensor pod and control unit to construct a lighting profile in accordance therewith.

WO 2006/111934 A1 discloses a method and a system for controlling at least one lighting arrangement, in which the lighting arrangement modulates the light it emits by lighting arrangement data, which contains an identification code identifying the lighting arrangement.

DE 4029274 A1 discloses environmental control in a windowless building that measures indoor factors including temperature, human activity and human body temperature and simulates the outdoor environment.

SUMMARY OF THE INVENTION

Light scenes created by one user or by a content provider for a particular lighting system may not be rendered on a lighting system of another user as intended by the creator of the light scenes or as desired by the other user, because the lighting systems may include different set of lighting devices, possibly with different capabilities, different locations with respect to each other, and/or different modes of use (for example, intended for functional lighting or ambient lighting).

Controlling each LED light source in a LED lighting system individually may result in too much complexity for the user, which may also be the case for lighting systems including controllable or adjustable light sources other than LEDs. Complexity may increase even further when dynamic light scenes are considered.

The above concerns may not be limited to the consumer lighting domain but may apply also to the professional lighting domain such as in retail or office environments, hospitality, healthcare, etc.

In view of the above, a concern of the present invention is to provide means for facilitating, possibly automatically, determination of an appropriate or even optimal light output for a particular lighting device in a lighting system for example for a predefined light scene or for an automatically created light scene.

A further concern of the present invention is to provide means for facilitating, possibly automatically, determination of an appropriate or even optimal light output for a particular lighting device in a lighting system for example for a predefined light scene or for an automatically created light scene, and for a particular user and/or a particular environment.

A further concern of the present invention is to provide means for facilitating, possibly automatically, determination of an appropriate or even optimal light output for a particular lighting device in a first lighting system for example for a predefined light scene which may have been created for another, second lighting system, possibly including a different set of lighting devices, which set of lighting devices may have different capabilities, different locations with respect to each other, and/or different modes of use, compared to a set of lighting devices in the first lighting system.

A further concern of the present invention is to provide means for simplifying use of a lighting system including controllable or adjustable lighting devices.

To address at least one of these concerns and other concerns, a processing module, a system and a method in accordance with the independent claims are provided. Preferred embodiments are defined by the dependent claims.

According to a first aspect of the present invention, there is provided a processing module, or a processing and/or control module, for use in conjunction with a lighting system which includes at least one controllable lighting device having a plurality of variable attributes, or parameters, relating to use of the at least one lighting device, each attribute having a range of available values. The processing module is configured, or adapted, or arranged, to receive usage data relating to any change in value or values of at least one attribute during use of the at least one lighting device, and, on basis of the usage data, determine a lighting device settings profile for the at least one lighting device, wherein the lighting device settings profile defines a value of at least one of the attributes.

Adjustment of attributes or settings of a lighting device in a lighting system may hence be monitored or logged, for example relating to, but not limited to, change of color, intensity, etc., of light emitted by the lighting device, or a time when a change in color, intensity, etc., of light emitted by the lighting device was made, or a change in an identifier of a user making a change in color, intensity, etc., of light emitted by the lighting device. Data thus obtained may be analyzed and used to determine or derive a lighting device settings profile for the lighting device. The lighting device settings profile may then be used, possibly in an automatic manner, to determine an appropriate or even optimal light output for the lighting device. The lighting device settings profile may according to one example be used to determine an appropriate or even optimal light output for the lighting device with respect to a predefined light scene, i.e. a predefined set of settings for the lighting device and possibly also any other lighting devices in the lighting system. Hence, the lighting device settings profile determined on basis of the usage data may for example be used to facilitate or optimize rendering or application of the predefined light scene on the lighting device(s) included in the lighting system. The predefined light scene may for example have been retrieved or downloaded or received from a third-party light scene content creator, e.g., via the Internet or another network. According to another example, the lighting device settings profile may be used to determine an appropriate or even optimal light output for the lighting device so as to create, possibly automatically, a new light scene.

Monitoring or logging adjustment of attributes or settings of a lighting device in a lighting system may facilitate or even allow for, for example, determining a typical or most frequently selected color setting of the lighting device, which information may be used for example to determine its mode of use (for example, if the lighting device is intended for functional lighting or for ambient lighting). Hence, the lighting device settings profile determined on basis of the usage data may for example be used to automatically create a new light scene for a particular use or even for a particular user and/or environment. For example, for the new light scene, colored light effects may be (possibly automatically) rendered on any lighting device intended for ambient lighting, and white light effects may be (possibly automatically) rendered on any lighting device intended for functional lighting.

Determination of, for example, a mode of use of a lighting device may for example be implemented or realized by means of a learning system or at least one machine learning technique. For example, a clustering technique may be applied to assign the usage data, or a subset of the usage data, to a meaningful cluster. The lighting device may then for example be classified as intended for functional lighting or ambient lighting by analysis of the most frequently selected color setting of the lighting device. For example, if the color setting is in a white range, i.e. close to black body line, the lighting device may be classified as intended for functional lighting. The most frequently selected settings, e.g. of color, brightness, intensity, saturation, color temperature, etc., of light emitted by the lighting device at various times of the day may be considered, and possibly which user that made the selection or adjustment. There may for example be a user who often or always selects a relatively high brightness or intensity of light emitted by a lighting device in the morning, and a relatively low brightness or intensity of light emitted by a lighting device in the evening. In this case, time-dependent lighting settings may be included in the lighting device settings profile for the lighting device. In addition, identity of which user that made the selection or adjustment may be considered, for example based an identifier of a user device or user equipment. In this case, user-dependent lighting settings may be included in the lighting device settings profile for the lighting device.

As will be further described in the following, data obtained by a sensing module configured to sense at least one environmental property of the environment in a region may in addition be taken into account in determining the lighting device settings profile for the lighting device. The region may for example be a region within which a lighting device may be configured to emit light. Data obtained by the sensing module, which hence may be said to represent 'environmental parameters', may for example be monitored or logged in order to associate environmental conditions with the usage data. As will be further described in the following, such environmental parameters may for example include weather information, ambient light conditions, sound, temperature, user activity, etc. Such association may be utilized in automatic light scene creation. For example, if it is determined that a user frequently or even always adjusts the light emitted by a lighting device from colored light to white light when performing a certain activity, such as entering a room or sitting down in a chair, the lighting device settings profile may be determined so as to allow for automatically adjusting the light emitted by the lighting device from colored light to white light if that activity by the user is sensed by the sensing module.

Embodiments of the present invention may provide several capabilities or functionalities, including, but not limited to:

facilitate or allow for determining whether a lighting device is used for functional lighting or ambient lighting, and use that information for determining an appropriate or even optimal light output for the lighting device with respect to a predefined light scene, or for automatically creating a new light scene for a particular use or even for a particular user or a particular environment, facilitate or allow for determining the most frequently selected color(s), intensity or intensities, etc., for a particular lighting device by a particular user, and tailor or create a new light scene to the most frequently selected color(s), intensity or intensities, etc., of that user, facilitate or allow for automatic adjustment of an attribute or setting of a lighting device based on adjustments of that attribute or setting made earlier, and/or facilitate or allow for determining a typical or expected usage of a lighting device for example during a certain time of day or year (or during another selected time period) by a particular user in order to allow for automatically adjusting the lighting device during that time of day or year to meet that user's preferred settings or use of the lighting device.

According to a second aspect of the present invention, there is provided a system, which for example may include or be constituted by a lighting system. The system comprises at least one controllable lighting device having a plurality of variable attributes relating to use of the at least one lighting device, wherein each attribute has a range of available values. The system comprises a processing module according to the first aspect of the present invention, configured to determine a lighting device settings profile for the at least one lighting device, wherein the lighting device settings profile defines a value of at least one of the attributes.

According to a third aspect of the present invention, there is provided a method for use in conjunction with a lighting system, the lighting system including at least one controllable lighting device having a plurality of variable attributes relating to use of the at least one lighting device, wherein each attribute has a range of available values. Usage data relating to any change in value or values of at least one attribute during use of the at least one lighting device is received. On basis of the usage data, a lighting device settings profile for the at least one lighting device is determined, wherein the lighting device settings profile defines a value of at least one of the attributes.

According to a fourth aspect of the present invention, there is provided a computer program product configured or adapted to, when executed in a processing module according to the first aspect of the present invention, perform a method according to the third aspect of the present invention.

According to a fifth aspect of the present invention, there is provided a computer-readable storage medium on which there is stored a computer program product configured or adapted to, when executed in a processing module according to the first aspect of the present invention, perform a method according to the third aspect of the present invention.

The at least one controllable lighting device may have light emission characteristics that are controllable (e.g. via a control system and/or the processing module), e.g. with respect to intensity, beam shape, beam direction, color, color temperature, saturation, and/or brightness, etc., of light emitted therefrom.

In the context of the present application, by an attribute relating to use of a lighting device it is meant a quantity or property determinative of an aspect of use of the lighting device, e.g. a light setting, such as, but not limited to, color or wavelength of light emitted by the lighting device, beam shape, beam direction, intensity, saturation and/or brightness of light emitted by the lighting device, a time instant at which or a time period during which an adjustment of an attribute was made, an identifier of a user which made an adjustment of an attribute, etc., or any combination thereof.

In the context of the present application, a user which made an adjustment of an attribute encompasses not only a person using a lighting device in the lighting system and who carries out an adjustment of the attribute, but also a user device or user equipment which carry out an adjustment of an attribute, etc. Hence, "user" may according to embodiments of the present invention refer to a person using a lighting device in the lighting system and who carries out an adjustment of an attribute and/or a user device or user equipment carrying out an adjustment of an attribute.

In the context of the present application, the terms "user device" and "user equipment" encompass devices such as wireless and/or wired transmit/receive units, mobile phones, tablet computers, personal digital assistants and/or so called smartphones, etc., or another suitable device which can be communicatively coupled or connected to the lighting system and/or to the at least one lighting device.

The variable attributes relating to use of the at least one lighting device may for example include attributes determinative of properties of light emitted by the at least one lighting device.

According to an embodiment of the present invention, the at least one lighting device may be adjustable with respect to intensity, beam shape, beam direction, color, saturation, hue and/or color temperature of light emitted by the at least one lighting device. The variable attributes determinative of properties of light emitted by the at least one lighting device may for example include intensity, beam shape, beam direction, color, saturation, hue, and/or color temperature of light emitted by the at least one lighting device.

According to an embodiment of the present invention, the attributes determinative of properties of light emitted by the at least one lighting device may for example include the most frequently selected intensity, beam shape, beam direction, color, saturation, hue, and/or color temperature of light emitted by the at least one lighting device during at least one selected time period. The at least one selected time period may for example be a certain time period during the day or night.

In the context of the present application, by the term time period, during which intensity, beam shape, beam direction, color, saturation, hue, and/or color temperature of light emitted by at least one lighting device was/were adjusted or controlled, it is generally meant an extended, consecutive period of time, but the term also encompasses a time instant or instants, or several non-consecutive extended periods of time.

According to an embodiment of the present invention, the variable attributes relating to use of the at least one lighting device may include identity of a user adjusting at least one other attribute. The attributes determinative of properties of light emitted by the at least one lighting device may according to examples include the most frequently selected intensity, beam shape, beam direction, color, saturation, hue, and/or color temperature of light emitted by the at least one lighting device by a particular user.

Generally, a lighting device settings profile as determined for at least one lighting device includes information regarding light settings of the at least one lighting device. The information in the lighting device settings profile may for example be used for automatic determination, selection and/or adjustment of a light scene in order to adapt, tailor or even optimize light output by the at least one lighting device for example to a particular user, activity, function or field of application or use. By a light scene it is in the context of the present application generally meant settings of the lighting device(s) included in the lighting system for achieving a certain light output by the lighting system.

Hence, by means of the lighting device settings profile, or information in the lighting device settings profile, a predefined light scene for the at least one lighting device, i.e. a predefined set of settings or values of at least some, most or even all attributes relating to use of the at least one lighting device, may be adjusted, for example so as to adapt, tailor or even optimize light output by the at least one lighting device for example to a particular user, activity, function or field of application or use. Such a predefined light scene may for example be one that is shared in a community of lighting device owners, e.g. via a private network or a public network such as the Internet, and/or one that is retrieved from a third-party light scene content creator, e.g. downloaded from a website of such a third-party light scene content creator.

In alternative or in addition, by means of the lighting device settings profile, or information in the lighting device settings profile, a light scene for the at least one lighting device can be automatically created or set up, wherein light output by the at least one lighting device can be tailored or even optimized for example to a particular user, activity, function or field of application or use.

A lighting device settings profile may for example include, but is not limited to, at least one of the following:

general information regarding light settings of the at least one lighting device, for example the most frequently selected color, beam shape, beam direction, brightness, color temperature, saturation or intensity of light emitted by the at least one lighting device, information regarding 'time-dependent' light settings, for example the most frequently selected color, beam shape, beam direction, brightness, color temperature, saturation or intensity of light emitted by the at least one lighting device during a certain time period, e.g., the most frequently selected color of light emitted by the at least one lighting device between 9.00 and 10.00, information regarding 'user-dependent' light settings, for example color, beam shape, beam direction, brightness, color temperature, saturation or intensity of light emitted by the at least one lighting device most frequently selected by a particular user, or user type, e.g. smartphone, possibly selected during a certain time period.

A lighting device settings profile may include information regarding 'combinations' of time-dependent light settings and user-dependent light settings, which according to a non-limiting example may be the color of light emitted by the at least one lighting device most frequently selected by a particular user in a certain period of time, e.g. between 9.00 and 10.00 in the morning.

The lighting system may be adapted, arranged or configured such that adjustment of at least one of the plurality of variable attributes relating to use of the at least one lighting device can be carried out by means of transmitting control signals or commands to the respective at least one lighting device.

For example, the processing module may be configured to generate control signals for controlling the at least one lighting device based on the lighting device settings profile determined for the respective one of the at least one lighting device.

The generated control signals may be transmitted to the at least one lighting device, whereby adjustment of at least one of the plurality of variable attributes relating to use of the at least one lighting device can be made based on the control signals. The processing module itself may be configured to transmit the control signals or commands to the at least one lighting device. In alternative or in addition, forwarding of the control signals or commands to the at least one lighting device may be carried out by means of an intermediate unit or units indirectly or directly communicatively coupled or connected to the processing module and to the at least one lighting device so as to form a communication link therebetween for allowing for transmission of signals, data, etc.

In alternative or in addition, a dedicated control device may be employed for forwarding of the control signals or commands to the at least one lighting device. Hence, the lighting system may comprise a control device configured to control the at least one lighting device by adjustment of at least one of the plurality of adjustable light emission properties by means of transmitting control signals to the respective at least one lighting device. The processing module may be configured to transmit the determined lighting device settings profile or profiles for the at least one lighting device to the control device, so as to facilitate for or enable the control device to transmit control signals to the respective ones of the at least one lighting device based on the respective lighting device settings profile, for controlling the lighting device.

An example which illustrates principles of embodiments of the present invention is described in the following.

A user B retrieves or receives a predefined light scene which has been created by a user A. Each of the users A and B may similarly to as described above refer to a person using a lighting system and/or a user device or user equipment for use in conjunction with the lighting system. The predefined light scene may for example be one that is shared in a community of lighting device owners (e.g. including users A and B), for example via a private network or a public network such as the Internet. Hence, user B may for example download the predefined light scene which has been created by a user A. The user A has created the predefined light scene for a particular lighting system setup which the user A has for example in a room in a home or in an office. By way of example, the lighting system setup of user A includes two lighting devices A1, A2 which are situated above a work desk, a kitchen table, etc., where functional lighting is needed, and therefore the two lighting devices A1, A2 are used to emit white light. The lighting system setup of user A further includes four lighting devices A3-A6 arranged close to or on the walls of the room, which lighting devices A3-A6 are used to provide ambient lighting with colored lighting effects. Further by way of example, user B has a lighting system setup which is different from that of user A. The lighting system setup of user B may be located in a room for example in a home or in an office. The lighting system setup of user B includes one lighting device B1 which is situated close to for example a chair and which is used to provide functional lighting, e.g. for reading, and therefore emits white light. The lighting system setup of user B further includes three lighting devices B2-B4 arranged on a cabinet or the like in the room and which are intended for providing ambient lighting with colored lighting effects. Usage data relating to use of the lighting devices B1-B4 is used to determine a lighting device settings profile for each of the lighting devices B1-B4 according to an embodiment of the present invention. Based on the lighting device settings profiles for the respective lighting devices B1-B4, the predefined light scene retrieved or received by user B may be applied to the lighting system setup of user B so that, possibly automatically, colored light effects may be rendered lighting devices B2-B4 and white light effects may be rendered on lighting device B1.

The at least one lighting device may be adapted, arranged or configured to emit light at least in part in a region, or area or space. The region, or area or space, may be an at least partially bounded or enclosed region such as one or more rooms in a structure or building. The region may in addition or alternatively include an outdoor region surrounding a structure or building having one or more rooms within which the at least one lighting device is configured to emit light.

The processing module may be further for use in conjunction with a sensing module, which for example may be included in the lighting system. The sensing module may be adapted, arranged or configured to sense at least one environmental property of the environment in a region, each environmental property having a range of available values representing the environmental property. As described further in the following, the at least one lighting device may be configured to emit light at least in part within the region for which the sensing module is configured to sense at least one environmental property of the environment therein.

The processing module may be communicatively coupled or connected with sensing module in a wired and/or wireless fashion as known in the art.

When or whenever a user changes a value or values of at least one attribute during use of the at least one lighting device, the sensing module may be triggered to sense a selected one or ones of at least one environmental property of the environment in the region, or even all environmental properties of the environment in the region, which the sensing module is capable of sensing. The triggering may be such that the sensed data reflects a 'snapshot' of the environmental properties of the environment in the region at the time when the value or values of the at least one attribute was/were adjusted.

According to an embodiment of the present invention, the sensing module may be included in the processing module, or the sensing module may be separately arranged with respect to the processing module and indirectly or directly communicatively coupled or connected to the processing module so as to allow for transmission of signals, data, etc. between the processing module and the sensing module.

The processing module may be configured to receive data relating to at least one environmental property of the environment in the region sensed by the sensing module. The processing module may be configured to determine correlation between the at least one environmental property and the usage data. The lighting device settings profile for the at least one lighting device may be determined on basis of the determined correlation.

Correlation between the at least one environmental property and the usage data may for example include, or be constituted by, an appropriate correlation coefficient as known in the art. Hence, determining correlation between the at least one environmental property and the usage data may comprise determining at least one correlation coefficient, which may describe or indicate a statistical measure of the degree to which changes to the at least one environmental property or the usage data predict change to the usage data or the at least one environmental property, respectively.

According to a sixth aspect of the present invention, there is provided a lighting system comprising at least one controllable lighting device having a plurality of variable attributes relating to use of the at least one lighting device, wherein each attribute has a range of available values. The lighting system comprises a sensing module configured to sense at least one environmental property of the environment in a region, wherein each environmental property has a range of available values representing the environmental property. The lighting system comprises a processing module configured, or adapted, or arranged, to receive usage data relating to any change in value or values of at least one attribute during use of the at least one lighting device, and receive data relating to at least one environmental property of the environment in the region sensed by the sensing module. The processing module may be configured to determine correlation between the at least one environmental property and the usage data. The processing module is configured to, on basis of the usage data, and possibly also on basis of the determined correlation, determine a lighting device settings profile for the at least one lighting device, wherein the lighting device settings profile defines a value of at least one of the attributes. The at least one lighting device may be configured to emit light at least in part within the region.

According to non-limiting examples, the sensing module may for example configured to sense:

light conditions in the region, acoustic conditions in the region, thermal conditions in the region, weather conditions in the region, presence information, or information regarding user activity or presence in the region, and/or air quality in the region.

Acoustic conditions in the region may for example include magnitude, pitch and/or type of sound, e.g. speech, music, etc., occurring in the region.

Thermal conditions in the region may for example include a temperature in the region, e.g., the ambient temperature.

Weather conditions in the region may for example include temperature, wind speed and/or direction, etc. Data or information on weather conditions may for example be determined by a weather station included in the sensing module or communicatively connected with the sensing module, so that the sensing module may sense weather conditions in the region by means of receiving or retrieving data or information on weather conditions from the weather station.

Light conditions in the region may for example include aspects of ambient light within the region, e.g. with respect to intensity and/or brightness, or 'self-illumination', i.e. illumination in the region effected by means of the at least one lighting device.

Air quality in the region encompasses for example humidity, degree of air circulation, etc., in the region.

As mentioned above, the region within which the sensing module is configured to sense at least one environmental property of the environment may be an indoor region or an outdoor region, or a combination of an indoor region and an outdoor region. For example, the region may include an outdoor region which surrounds a structure or building having one or more rooms within which the at least one lighting device is adapted to emit light, and which one or more rooms are also included in the region.

The at least one environmental property of the environment in the region may for example include at least one lighting property, at least one thermal property, at least one weather property, at least one acoustic property, presence information, humidity and/or at least one air circulation property.

Presence information may for example include information on presence of any persons or users being present within the region, or information on location of any persons or users being present within the region. In alternative or in addition, the presence information may include information on identity of any persons being present within the region. The presence information may hence include information identifying a particular user or person being present within the region. For sensing presence information presence or motion detectors or sensors may be employed, which may use different techniques for detecting presence or motion. Examples include but are not limited to Passive Infrared detectors, Ultrasonic motion detectors, detectors based on a combination of Passive Infrared and Ultrasonic techniques, and camera-based sensors. Further examples include detectors based on radar, sound and pressure.

The sensing module may be at least in part implemented in a user device or user equipment. For example, in case the user device or user equipment includes a smartphone, a tablet computer, or the like, the sensing module may include a clock unit, a microphone, a camera, an accelerometer, etc., which may be included in the smartphone or tablet computer or the like. In alternative or in addition the sensing module may be at least in part implemented or integrated in the lighting devices. In alternative or in addition, the sensing module may comprise dedicated sensors such as, but not limited to, a temperature sensor, a presence or motion detector or sensor, an air quality sensor, etc. The above should however be considered merely as illustrative examples of how implementation of the sensing module may be carried out. Other examples are contemplated, including for example sensors or sensing equipment included in so called smart TVs, kitchen appliances, air purifiers, audiovisual equipment, personal care devices or other types consumer appliances.

The processing module may be configured to, based on a determined correlation and at least one selected correlation criterion, determine an extent or degree of correlation between at least one environmental property of the environment in the region sensed by the sensing module and the usage data.

Based on the extent or degree of correlation between the at least one environmental property of the environment in the region sensed by the sensing module and the usage data, at least one weight factor may be determined. The control signals for controlling the at least one lighting device may be generated further based on the at least one weight factor.

Hence, a degree of correlation between sensing module output(s) and a selected light scene may be used as a weighting factor for aspects in the lighting device settings profile for the at least one lighting device. For example, if a parameter 'time of day', 'current time', etc., sensed by the sensing module is determined to be relatively highly correlated with a certain selected intensity level of light emitted by the at least one lighting device, that parameter may get a relatively high weight factor in setting of the intensity level of light emitted by the at least one lighting device in an automatically created light scene. The control signals for controlling the at least one lighting device may then be generated with a relatively high weight factor for 'time of day', 'current time', etc. According to another example, if a parameter 'room temperature' sensed by the sensing module is determined to have a relatively low correlation with a certain selected saturation level of light emitted by the at least one lighting device, that parameter may get a relatively low weight factor in setting of the saturation level of light emitted by the at least one lighting device in an automatically created light scene. According to another example, if a parameter 'outdoor temperature' sensed by the sensing module is determined to be relatively highly correlated with a certain selected color temperature of light emitted by the at least one lighting device (e.g., if when it is relatively cold weather outside, a relatively warm color temperature of light emitted by the at least one lighting device is always or frequently selected), that parameter may get a relatively high weight factor in setting of the color temperature of light emitted by the at least one lighting device in an automatically created light scene. The control signals for controlling the at least one lighting device may then be generated with a relatively high weight factor for 'outdoor temperature'.

Determination of degree of correlation between the at least one environmental property and the usage data may for example be implemented or realized by means of a learning system or at least one machine learning technique.

By a combination of data on the at least one environmental property with the usage data, a learning system or at least one machine learning technique may be used in order to associate for example adjustments in lighting device settings or attributes with data on the at least one environmental property at the time the adjustments were made. For such associative learning, Bayesian networks or reinforcement learning techniques may be employed. This may allow for deriving probabilistic rules in order for a lighting device to automatically adjust its light output based on sensing module output(s). For example, if a user is found by means of sensing module output(s) to be entering a room at a certain time of day, and thereafter frequently selecting a certain light scene by adjustments in lighting device settings or attributes, such rules may be used to automatically render a light scene on the lighting system that the user frequently selects when the user enters that room at that time of day.

In view of the above, according to an embodiment of the present invention, the attributes determinative of properties of light emitted by the at least one lighting device may include the most frequently selected intensity, beam shape, beam direction, color, saturation, hue, and/or color temperature of light emitted by the at least one lighting device when at least one environmental property of the environment in the region sensed by the sensing module is equal to a selected value or within a selected range of values.

A lighting device settings profile may in addition or in alternative hence include 'sensing module-dependent' light settings, for example the most frequently selected color, beam shape, beam direction, brightness, color temperature, saturation or intensity of light emitted by the at least one lighting device when the temperature in the region is equal to a particular temperature, when a certain activity of a user is detected, etc.

The processing module may comprise a memory unit configured to store usage data relating to any change in value or values of at least one attribute relating to use of the at least one lighting device during use of the at least one lighting device and obtained during at least one period of time. The processing module may be configured to retrieve usage data stored in the memory unit. Usage data stored in the memory unit may for example include history of (past) usage data.

The processing module may be configured to determine the lighting device settings profile for the at least one lighting device on basis of the retrieved usage data.

According to an embodiment of the present invention, the processing module may be configured to, based on at least one statistical measure of the retrieved usage data obtained during the at least one period of time, predict an expected field of application or use, or mode of use, of the at least one lighting device.

The statistical measure may for example comprise but is not limited to a mean value.

The at least one statistical measure of the retrieved usage data obtained during the at least one period of time may for example be used to determine a typical or most frequently selected color setting of the at least one lighting device, which information may be used to determine the mode of use of the at least one lighting device, for example, if the at least one lighting device is intended for functional lighting or for ambient lighting.

The determined lighting device settings profile may then be used to automatically create a new light scene for a particular use or even for a particular user or a particular environment. For example, for a new light scene, colored light effects may be rendered on any lighting device of the lighting system intended for ambient lighting, and white light effects may be rendered on any lighting device of the lighting system intended for functional lighting.

Hence, the control signals for controlling the at least one lighting device may be generated based on an expected field of application of the at least one lighting device, e.g. as predicted based on at least one statistical measure of retrieved usage data obtained during at least one period of time, or based on at least one statistical measure of history of (past) usage data.

In the context of the present application, by the term "smartphone" it is generally meant a mobile phone built on a mobile operating system having functionality including one or several of a portable media player, sensors such as an imaging device, e.g., a digital camera, microphone, accelerometer, etc., and a Global Positioning System (GPS) navigation unit, etc., combined with the functionality of a mobile phone. Smartphones may include a user interface e.g. including a touch-sensitive screen or the like, capable of displaying e.g. web browsers that can display standard web pages as well as web pages optimized for viewing by a mobile device, and be capable of transmitting and receiving signals, data, etc., e.g. by means of Wi-Fi. The mobile operating systems used by a smartphone may include Android from Google, iOS from Apple, Symbian from Nokia, BlackBerry OS from RIM ("Research in Motion"), etc.

In the context of the present application, by the term "tablet computer" it is generally meant a mobile computer with display, circuitry and battery in a single unit. Tablet computers may be equipped with sensors for example including camera, microphone, accelerometer. Tablet computers are generally equipped with a touch-sensitive screen which allow for user input by means of finger or stylus gestures. An example of a tablet computer is iPad designed and marketed by Apple, Inc.

Further objects and advantages of the present invention are described in the following by means of exemplifying embodiments.

BRIEF DESCRIPTION OF THE DRAWINGS

Exemplifying embodiments of the invention will be described below with reference to the accompanying drawings.

All the figures are schematic, not necessarily to scale, and generally only show parts which are necessary in order to elucidate embodiments of the present invention, wherein other parts may be omitted or merely suggested.

DETAILED DESCRIPTION OF THE DRAWINGS

The present invention will now be described hereinafter with reference to the accompanying drawings, in which exemplifying embodiments of the present invention are shown. The present invention may, however, be embodied in many different forms and should not be construed as limited to the embodiments set forth herein; rather, these embodiments are provided by way of example so that this disclosure will convey the scope of the invention to those skilled in the art.

Figure 1:
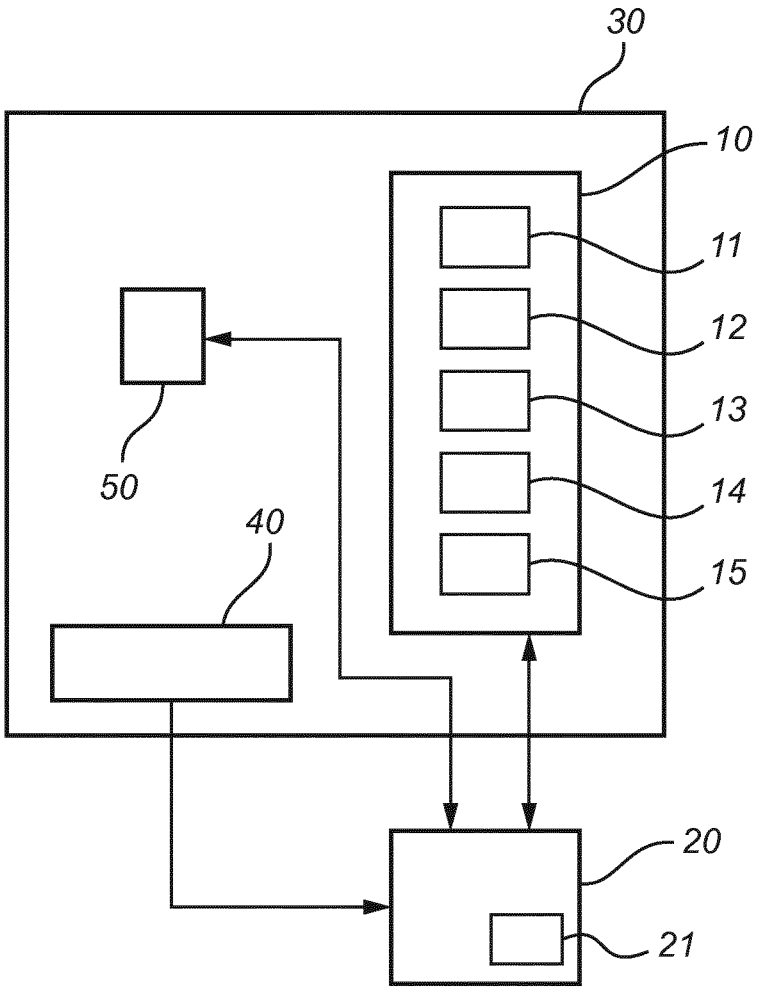
FIG. 1 is a schematic block diagram illustrating a lighting system and a processing module for use in conjunction with the lighting system in accordance with an embodiment of the present invention.

Referring now to FIG. 1, there is shown a schematic block diagram illustrating a lighting system 10 and a processing module 20 for use in conjunction with the lighting system 10 in accordance with an embodiment of the present invention. The processing module 20 can be implemented with at least one processor. The lighting system 10 includes a plurality of lighting devices 11-15. The number of lighting devices 11-15 shown in FIG. 1 is according to an example and shall not be construed as limiting the present disclosure. The lighting system 10 may in principle comprise any positive integer number of lighting devices. At least some of the lighting devices 11-15 may be communicatively connected by means of a wired and/or wireless communication link as known in the art, for transmitting of signals, commands, data, etc., therebetween. Each of the lighting devices 11-15 has a plurality of variable attributes relating to use of the lighting device 11-15. Each of the lighting devices 11-15 is controllable or adjustable with respect to the plurality of variable attributes relating to use of the respective lighting device 11-15. The lighting system 10 is configured such that adjustment of at least one of the plurality of variable attributes relating to use of the respective lighting devices 11-15 can be carried out by means of transmitting control signals to the respective ones of the lighting devices 11-15. Adjustment of at least one of the plurality of variable attributes relating to use of the respective lighting devices 11-15 by means of transmitting control signals to the respective lighting device 11-15 can be carried out for example by means of a dedicated control system (not shown in FIG. 1), the processing module 20 and/or a user device or user equipment 50 (hereinafter, "user"), etc. The user 50 may for example comprise a smartphone or the like.

For example, each of the lighting devices 11-15 may have light emission characteristics that are controllable or adjustable. The light emission characteristics may for example include intensity, beam shape, beam direction, color, color temperature, saturation, and/or brightness, etc., of light emitted by the respective lighting devices 11-15. However, the attributes relating to use of the respective lighting devices 11-15 are not limited to light emission characteristics or properties, but may in general include a quantity or property determinative of an aspect of use of the respective lighting devices 11-15, such as, but not limited to, color or wavelength of light emitted by the respective lighting devices 11-15, and/or intensity, saturation and/or brightness of light emitted by the respective lighting devices 11-15, a time instant at which or a time period during which an adjustment of an attribute was made, an identifier or identity of a user, e.g. the user 50, which made an adjustment of an attribute, etc., or any combination thereof.

Each attribute of the plurality of variable attributes relating to use of the respective lighting devices 11-15 has a range of available values. The processing module 20 is configured to receive usage data relating to any change in value or values of at least one attribute during use of the respective lighting devices 11-15.

According to the embodiment depicted in FIG. 1, the usage data is generated in the lighting system 10 or in the respective lighting devices 11-15 themselves and transmitted to the processing module 20. The lighting system 10 and the processing module 20 may be communicatively connected by means of a wired and/or wireless communication link as known in the art, for transmitting of signals, commands, data, etc., from the lighting system 10 to the processing module 20 and possibly also from the processing module 20 to the lighting system 10. According to another example, transmission of signals, commands, data, etc., between the lighting system 10 and the processing module 20 may be carried out by means of an intermediate unit or units (not shown in FIG. 1), e.g. a network bridge or a remote server or the like as known in the art, indirectly or directly communicatively connected to the processing module 20 and to the lighting device 10 so as to form a wired and/or wireless communication link as known in the art therebetween.

The processing module 20 is configured to, on basis of the usage data, determine a lighting device settings profile for the respective lighting devices 11-15. Each of the lighting device settings profiles as determined for the respective lighting devices 11-15 defines a value of at least one of the attributes for the respective lighting device 11-15.

The arrangement of the different elements in FIG. 1 relatively to each other as depicted in FIG. 1 is according to an example, and variations are possible and within the scope of embodiments of the present invention. For example, the processing module 20 may be included in the user 50, or in the lighting system 10.

The lighting device settings profile for the respective lighting devices 11-15 may for example include, but is not limited to, general information regarding light settings of the at least one lighting device, information regarding 'time-dependent' light settings, information regarding 'user-dependent' light settings, and/or 'sensing module-dependent' light settings, such as have been described in the foregoing, or information regarding any 'combination' of time-dependent light settings, user-dependent light settings and sensing-module-dependent light settings.

The lighting system 10 is configured such that adjustment of at least one of the plurality of variable attributes relating to use of the respective lighting devices 11-15 can be carried out by means of transmitting control signals or commands to the respective lighting device 11-15. The processing module 20 is configured to generate control signals for controlling the respective lighting devices 11-15 based on the lighting device settings profile determined for the respective lighting device 11-15.

According to an example, the processing module 20 may be configured to transmit the generated control signals or commands to the respective lighting devices 11-15. According to another example, forwarding of the control signals or commands to the respective lighting devices 11-15 may be carried out by means of an intermediate unit or units indirectly or directly communicatively coupled or connected to the processing module 20 and to the lighting system 10 or the individual lighting devices 11-15 so as to form a wired and/or wireless communication link as known in the art therebetween for allowing for transmission of signals, data, etc.

According to the embodiment depicted in FIG. 1, each of the lighting devices 11-15 is configured to emit light at least in part in a region 30. A sensing module 40 may be provided, which is configured to sense at least one environmental property of the environment in the region 30, wherein each environmental property has a range of available values representing the environmental property.

The arrangement of the sensing module 40 within the region 30 is according to an example, and the sensing module 40 may in alternative be arranged outside the region 30. According to another example the sensing module 40 may be included in the lighting system 10.

Irrespective of its location, the sensing module 40 may be communicatively connected with processing module 20 by means of a wired and/or wireless communication link as known in the art, for transmitting of signals, commands, data, etc., from the sensing module 40 to the processing module 20 and possibly also from the processing module 20 to the sensing module 40. According to another example, transmission of signals, commands, data, etc. between the sensing module 40 and the processing module 20 may be carried out by means of an intermediate unit or units (not shown in FIG. 1), e.g. a network bridge or a remote server or the like as known in the art, indirectly or directly communicatively connected to the processing module 20 and to the sensing module 40 so as to form a wired and/or wireless communication link as known in the art therebetween.

According to the embodiment depicted in FIG. 1, the processing module 20 is configured to receive data relating to at least one environmental property of the environment in the region 30 sensed by the sensing module 40, and determine correlation between the at least one environmental property and the usage data. The processing module 20 is configured to determine the lighting device settings profile for the respective lighting devices 11-15 further on basis of the determined correlation. Correlation between the at least one environmental property and the usage data may for example include, or be constituted by, an appropriate correlation coefficient as known in the art.

The processing module 20 may be configured to, based on a determined correlation and at least one selected correlation criterion, determine an extent or degree of correlation between at least one environmental property of the environment in the region 30 sensed by the sensing module 40 and the usage data. The processing module 20 may be configured to, based on the extent or degree of correlation between the at least one environmental property of the environment in the region 30 sensed by the sensing module 40 and the usage data, determine at least one weight factor. The control signals for controlling the respective lighting devices 11-15 may be generated (further) based on the at least one weight factor. Hence, a degree of correlation between output(s) from the sensing module 40 and a selected light scene may be used as a weighting factor for aspects in the lighting device settings profile for the respective ones of the lighting devices 11-15.

According to the embodiment depicted in FIG. 1, the processing module 20 comprises a memory unit 21 which is configured to store usage data relating to any change in value or values of at least one attribute relating to use of the respective lighting devices 11-15 during use thereof and obtained during at least one period of time. The processing module 20 is configured to retrieve usage data stored in the memory unit 21, and determine the lighting device settings profile for the respective lighting devices 11-15 on basis of the retrieved usage data. The processing module 20 may be configured to, based on at least one statistical measure of the retrieved usage data obtained during the at least one period of time, predict an expected field of application of at least one of the lighting devices 11-15. Usage data stored in the memory unit 21 may for example include history of (past) usage data.

Figure 2:
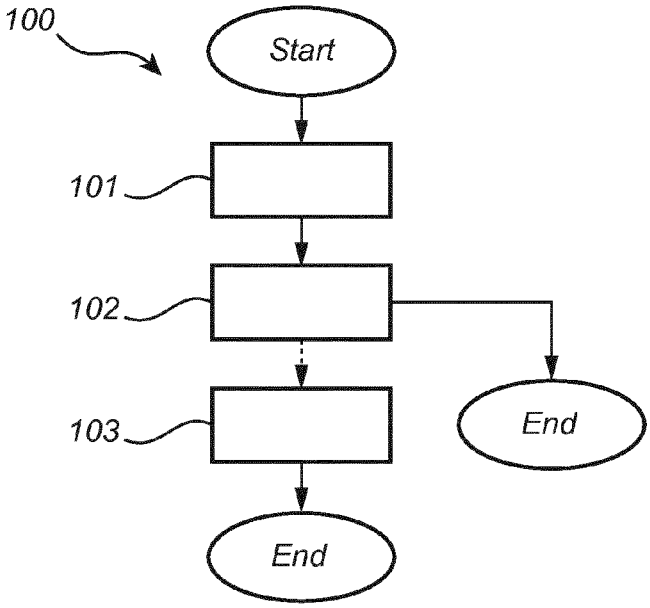
FIG. 2 is a schematic flowchart of a method according to an embodiment of the present invention.

Referring now to FIG. 2, there is shown a schematic flow diagram of a method 100 according to an embodiment of the present invention. The method 100 is for use in conjunction with a lighting system which includes at least one controllable lighting device having a plurality of variable attributes relating to use of the at least one lighting device, wherein each attribute has a range of available values. The method 100 comprises receiving usage data relating to any change in value or values of at least one attribute during use of the at least one lighting device, 101. On basis of the usage data, a lighting device settings profile for the at least one lighting device is determined, 102. The lighting device settings profile for the at least one lighting device defines a value of at least one of the attributes. Optionally, the method 100 further comprises generating control signals for controlling the at least one lighting device based on the lighting device settings profile determined for the respective at least one lighting device, 103.

Figure 3:
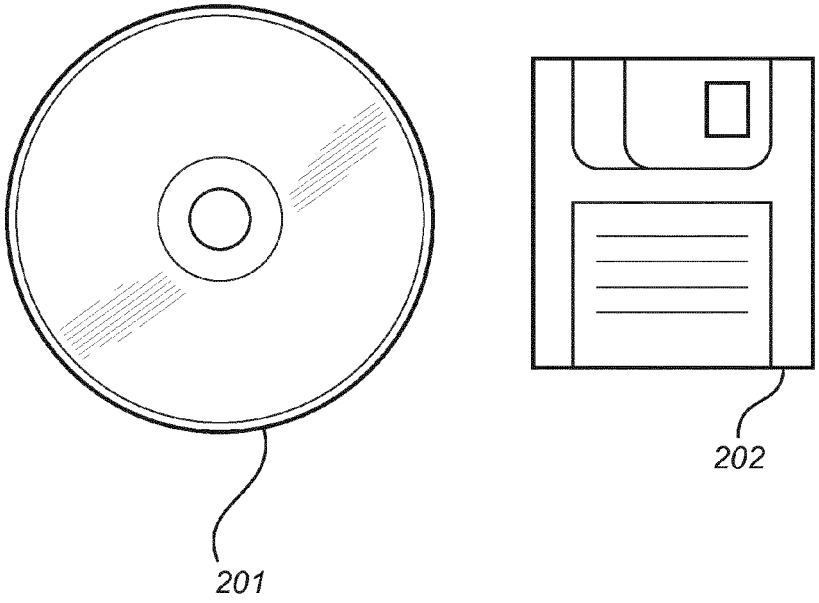
FIG. 3 is a schematic view of computer-readable means, or computer-readable storage mediums, according to embodiments of the present invention.

Referring now to FIG. 3, there is shown a schematic view of computer-readable means, or computer-readable storage mediums, 201, 202 according to embodiments of the present invention. By way of example, the computer-readable storage mediums 201, 202 depicted in FIG. 3 comprise a floppy disk 202 and a Digital Versatile Disc (DVD) 201.

With reference to FIG. 1, on the computer-readable storage mediums 201, 202 there may be stored computer program code configured to, when executed in the processing module 20, perform a method 100 as described in the foregoing with reference to FIG. 2.

Although two particular types of computer-readable storage mediums 201, 202 by way of example have been described above with reference to FIG. 3, the present invention encompasses embodiments employing any other suitable type of computer-readable storage medium, such as, but not limited to, a memory, a hard disk drive, a Compact Disc (CD), a flash memory, magnetic tape, a USB stick, a Zip drive, etc. The memory may for example be any combination of read and write memory (RAM) and read only memory (ROM).

In conclusion, there is disclosed a processing module configured to receive usage data for at least one lighting device and on basis of the usage data determine a lighting device settings profile for the at least one lighting device.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. At least one processor for use in conjunction with a lighting system including at least one lighting device adjustable with respect to intensity, beam shape, beam direction, color, saturation, hue and/or color temperature of light emitted, the at least one lighting device having a plurality of variable attributes relating to use of the at least one lighting device, wherein the variable attributes relating to use of the at least one lighting device include attributes determinative of properties of light emitted by the at least one lighting device, wherein the variable attributes determinative of properties of light emitted by the at least one lighting device include intensity, beam shape, beam direction, color, saturation, hue, and/or color temperature of light emitted by the at least one lighting device, each attribute having a range of available values, the lighting system being configured such that adjustment of at least one of the plurality of variable attributes relating to use of the at least one lighting device can be carried out by means of transmitting control signals to the respective at least one lighting device, the processor being configured to: receive usage data from the lighting system, the usage data relating to any change in value or values of at least one attribute during use of the at least one lighting device, on basis of the usage data, determine a lighting device settings profile for the at least one lighting device, the lighting device settings profile defining a mode of use of the at least one lighting device that is determined by the processor based on the usage data; and on basis of the lighting device settings profile, generating the control signals for controlling the at least one lighting device based on the defined mode of use determined for the respective at least one lighting device; wherein the processor is configured to receive second data defining a lighting scene and to determine said control signals based on both said second data and said usage data such that said control signals cause light output of the lighting device to replicate said lighting scene based on said usage data.

2. The processor according to claim 1, wherein the processor is further for use in conjunction with a sensing module configured to sense at least one environmental property of the environment in a region, each environmental property having a range of available values representing the environmental property, the processor being further configured to:

receive data relating to at least one environmental property of the environment in the region sensed by the sensing module;

determine correlation between the at least one environmental property and the usage data; and determine the lighting device settings profile for the at least one lighting device further on basis of the determined correlation.

3. The processor according to claim 2, the processor being further configured to:

based on the determined correlation and at least one selected correlation criterion, determine an extent of correlation between at least one environmental property of the environment in the region sensed by the sensing module and the usage data;

based on the extent of correlation, determine at least one weight factor; and generate the control signals for controlling the at least one lighting device further based on the at least one weight factor.

4. The processor according to claim 3, wherein the attributes determinative of properties of light emitted by the at least one lighting device include the most frequently selected intensity, beam shape, beam direction, color, saturation, hue, and/or color temperature of light emitted by the at least one lighting device during at least one selected time period.

5. The processor according to claim 4, wherein the variable attributes relating to use of the at least one lighting device include identity of a user adjusting at least one other attribute, and wherein the attributes determinative of properties of light emitted by the at least one lighting device include the most frequently selected intensity, beam shape, beam direction, color, saturation, hue, and/or color temperature of light emitted by the at least one lighting device by a particular user.

6. The processor according to claim 5, wherein the attributes determinative of properties of light emitted by the at least one lighting device include the most frequently selected intensity, beam shape, beam direction, color, saturation, hue, and/or color temperature of light emitted by the at least one lighting device when at least one environmental property of the environment in the region sensed by the sensing module is equal to a selected value or within a selected range of values.

7. The processor according to claim 1, wherein the variable attributes relating to use of the at least one lighting device include identity of a user adjusting at least one other attribute, and/or a time instant when or a time period during which at least one other attribute was adjusted.

8. The processor according to claim 1, comprising a memory unit configured to store usage data relating to any change in value or values of at least one attribute relating to use of the at least one lighting device during use of the at least one lighting device and obtained during at least one period of time, the processor being further configured to:

retrieve usage data stored in the memory unit;

determine the lighting device settings profile for the at least one lighting device on basis of the retrieved usage data; and based on at least one statistical measure of the retrieved usage data obtained during the at least one period of time, predict an expected field of application of the at least one lighting device.

9. A system comprising:

at least one lighting device having a plurality of variable attributes relating to use of the at least one lighting device, wherein the variable attributes relating to use of the at least one lighting device include attributes determinative of properties of light emitted by the at least one lighting device, each attribute having a range of available values; and the processor according to claim 1 configured to determine a lighting device settings profile for the at least one lighting device, the lighting device settings profile defining a value of at least one of the attributes.

10. The processor according to claim 1, wherein the lighting system is a first lighting system and wherein the lighting scene is designed for a second lighting system that has a lighting device configuration that is different from a configuration of said at least one lighting device of said first lighting system.

11. The processor according to claim 1, wherein the mode of use of the at least one lighting device is a purpose, for which the at least one lighting device is used, that is indicated by the usage data.

12. The processor according to claim 1, wherein the processor is configured to determine the mode of use of the at least one lighting device by determining whether the at least one lighting device is used for functional lighting or ambient lighting based on the usage data.

13. A method for use in conjunction with a lighting system including at least one lighting device adjustable with respect to intensity, beam shape, beam direction, color, saturation, hue and/or color temperature of light emitted, the at least one lighting device having a plurality of variable attributes relating to use of the at least one lighting device, wherein the variable attributes relating to use of the at least one lighting device include attributes determinative of properties of light emitted by the at least one lighting device, wherein the variable attributes determinative of properties of light emitted by the at least one lighting device include intensity, beam shape, beam direction, color, saturation, hue, and/or color temperature of light emitted by the at least one lighting device, each attribute having a range of available values, the lighting system being configured such that adjustment of at least one of the plurality of variable attributes relating to use of the at least one lighting device can be carried out by means of transmitting control signals to the respective at least one lighting device, the method comprising: receiving usage data from the lighting system, the usage data relating to any change in value or values of at least one attribute during use of the at least one lighting device, on basis of the usage data, determining a mode of use and a lighting device settings profile for the at least one lighting device, the lighting device settings profile defining the mode of use of the at least one lighting device; and on basis of the lighting device settings profile, generating the control signals for controlling the at least one lighting device based on the defined mode of use determined for the respective at least one lighting device; receiving second data defining a lighting scene, and determining said control signals based on both said second data and on said usage data such that said control signals cause light output of the at least one lighting device to replicate said lighting scene based on said usage data.

14. A computer program product configured to, when executed by a processor, perform the method of claim 13.

15. A computer-readable storage medium on which there is stored a computer program product configured to, when executed by a processor, perform the method of claim 13.

16. The method of claim 13, wherein the lighting system is a first lighting system and wherein the lighting scene is designed for a second lighting system that has a lighting device configuration that is different from a configuration of said at least one lighting device of said first lighting system.

17. The method of claim 13, wherein the mode of use of the at least one lighting device is a purpose, for which the at least one lighting device is used, that is indicated by the usage data.

18. The method of claim 13, wherein the determining the mode of use comprises determining whether the at least one lighting device is used for functional lighting or ambient lighting based on the usage data.

* * * * *